US006455213B1

(12) United States Patent
Lee

(10) Patent No.: US 6,455,213 B1
(45) Date of Patent: Sep. 24, 2002

(54) METHOD FOR MANUFACTURING PHOSPHOR LAYER FOR IMAGE DISPLAY APPARATUS

(75) Inventor: Keun Pil Lee, Kumi (KR)

(73) Assignee: LG Electronics, Inc., Seoul (KR)

( * ) Notice: Subject to any disclaimer, the term of this patent is extended or adjusted under 35 U.S.C. 154(b) by 0 days.

(21) Appl. No.: 09/477,345

(22) Filed: Jan. 4, 2000

(51) Int. Cl.[7] ..... H01J 9/227
(52) U.S. Cl. ..... 430/23
(58) Field of Search ..... 430/23; 252/301.4 R

(56) References Cited

U.S. PATENT DOCUMENTS 5,644,193 A * 7/1997 Matsuda et al. ..... 313/486
5,677,071 A 10/1997 Kang
6,180,029 B1 * 1/2001 Hampden-Smith et al. ..... 252/301.4 R

FOREIGN PATENT DOCUMENTS

JP 5-331463 * 12/1993
JP 8-109375 * 4/1996
JP 10-088127 * 4/1998
JP 10-154466 * 6/1998

* cited by examiner

*Primary Examiner*—John A. McPherson
(74) *Attorney, Agent, or Firm*—Birch, Stewart, Kolasch & Birch, LLP

(57) ABSTRACT

A phosphor surface formation method for an image display apparatus is disclosed. This method is characterized in that a rounded phosphor material having an aspect ratio(=shorter axis/longer axis) of 0.8~1.0 is used as a phosphor material, and an average particle size(d50: the particle size in which the volume of the whole particles is 50%) is in a range of 1~8 $\mu$m for thereby forming a phosphor surface wherein the phosphor surface is formed by manufacturing a phosphor slurry including a phosphor material, coating the phosphor slurry on an upper surface of the panel, light-exposing the same using a ultraviolet ray, and removing a non-exposed portion by developing using a pressurized pure water.

11 Claims, 2 Drawing Sheets

METHOD FOR MANUFACTURING PHOSPHOR LAYER FOR IMAGE DISPLAY APPARATUS

BACKGROUND OF THE INVENTION

1. Field of the Invention

The present invention relates to a phosphor layer for an image display apparatus, and in particular to a phosphor layer formation method for obtaining a high luminance and coating characteristic.

2. Description of the Background Art

In a conventional image display apparatus, energy is transferred to a phosphor surface formed on a panel 1 from an electron gun or a current generation apparatus in an amount which is capable of causing light to be emitted from a phosphor material thereby reproducing an image.

To form the phosphor surface, a phosphor material slurry is coated on the upper surface of the panel 1, and R, G, B phosphor material dots are formed on the panel by an ultraviolet ray exposure. Smaller phosphor material is used for the phosphor material slurry for enhancing a coating and filling characteristic of the coating surface. In addition, the shape of the phosphor layer is oval-shaped and hexagonal. The above-described phosphor layer has an aspect ratio (=shorter axis/longer axis) of 0.5~0.75.

The PVA (Polyvinyl Alcohol) phosphor slurry coated on the upper surface of the panel 1 is selectively exposed to ultraviolet rays, and the non-exposed slurry is removed by pressurized water for reproducing spotlights or dots or phosphor material on panel 1. During the light exposure, the ultraviolet ray should pass through the panel 1 for thereby coupling the PVA for thereby enhancing an adhesive force between the panel 1 and the dots. Namely, the adhesive force between the panel 1 and the dots of the phosphor is enhanced by increasing the light transitivity.

However, in the conventional phosphor layer (which is oval-shaped and hexagonal), the packing structure is too tight based on a constant light exposing amount as shown in FIG. 2, so that the light transitivity is decreased. In addition, some of the ultraviolet does not transmit to the inner portion of the phosphor layer and the panel 1, so that some of the adhesive force between the panel 1 and the dots is decreased. Therefore, cracks occur, and the coated state is degraded, and the luminance is decreased.

In order to overcome the above-described problems, in order to increase the light transitivity, the light intensity can be increased, or the light exposing time can be increased, so that the dot width is increased, but as a result a color mixing problem can occur.

In addition, the distribution of the conventional phosphor particle size has a Gaussian distribution due to the manufacturing characteristic. FIG. 1 illustrates a distribution by adapting a phosphor material having an average particle size of 6.5 $\mu$m.

In FIG. 1, the sum of the volume of the particles in which the size of the particle starts 0 is 50% as d50 is assumed as d50. This value is an average particle size. The Quartile Deviation (Q.D.) is a parameter representing a degree of uniform distribution of particle size based on average size. The values Q and D are (d75−d25)/(d75+d25), and the distribution of the particle size becomes a reference for the uniform distribution based on the average size.

Here, the particle size distribution of the conventional phosphor material, in which the average particle size (d50) is 6.5 $\mu$m, is 5% for each below 3 $\mu$m and above 12 $\mu$m, and the Q.D=(d75−d25)/(d75+d25) value is below 0.22. Therefore, the amount of elementary particles and alleles is too large, so that the packing structure of the phosphor material becomes compacted, so that the light transitivity is decreased. The phosphor is formed using the particles of 1~5 $\mu$m, the packing structure of the phosphor becomes compacted, so that when an electron beam penetrates during the light exposure of the ultraviolet ray and when the phosphor material emits light, the particles does not penetrate into the lower surface for thereby decreasing the luminance.

In addition, the elementary particle phosphor material has a rapid luminance variation due to the variation of a film thickness, so that it is impossible to obtain an optimum film thickness which has the maximum luminance. In the fabrication line, in order to prevent any cracks of the phosphor material dots, the density of the phosphor slurry is increased, and the viscosity of the same is decreased. Therefore, a mixing problem may occur, and a filling problem may occur. In addition, the luminance may be decreased because the optimum film thickness of the phosphor surface is not obtained.

SUMMARY OF THE INVENTION

Accordingly, it is an object of the present invention to provide a method for manufacturing a phosphor layer for an image display apparatus which is capable of obtaining good coating characteristic and enhancing a luminance.

To achieve the above object, there is provided a phosphor surface formation method for an image display apparatus which is characterized in that a rounded phosphor material having an aspect ratio (=shorter axis/longer axis) of 0.8~1.0 is used as a phosphor material, and an average particle size (d50 the particle size in which the volume of the whole particles is 50%) is in a range of 1~8 $\mu$m for thereby forming a phosphor surface wherein the phosphor surface is formed by manufacturing a phosphor slurry including a phosphor material, coating the phosphor slurry on an upper surface of the panel, light-exposing the same using ultraviolet rays, and removing a non-exposed portion by developing using pressurized pure water.

Additional advantages, objects and features of the invention will become more apparent from the description which follows.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 4A through 4C are views illustrating a reflection characteristic of a phosphor material according to the present invention, of which:

FIG. 4A is a view illustrating a description of a normal state;

FIG. 4B is a view illustrating a coated state, not overlapped; and

FIG. 4C is a view illustrating a coated state and a state that a phosphor material particle is overlapped by 30%.

DETAILED DESCRIPTION OF THE PREFERRED EMBODIMENTS

The embodiments of the present invention will be explained with reference to the accompanying drawings.

The shape of a phosphor material, which is the most important factor affecting a luminance of a phosphor surface, is rounded compared to the conventional oval- and hexagonal-shape. In addition, the size of the particle of the phosphor layer is larger than that of the conventional phosphor material.

Namely, the aspect ratio (=shorter axis/longer axis) of the phosphor layer is 0.8~1.0 which nearly corresponds to a circle, and the average particle size of the phosphor material is 1~8 $\mu$m.

In addition, the distribution below d25 (the particle size which is ½ of d50 of the average particle size of the phosphor material) and above d75 (the particle size of ⅜ of d50 of the average particle size of the phosphor material) is below 5%, and the value of Q.D (=(d75−d25)/(d75+d25)) is below 0.2.

When forming the optimum thickness of the phosphor material (which is an important factor together with the shape and size of the phosphor), in the case of green and blue colors, the thickness is SW (Screen Weight: Weight of the phosphor film per unit area space (mg/cm$^2$)) (0.38~0.42)× d50, and in case of the red color, the thickness of (0.38~0.42)×1.2(mg/cm$^2$). The actual viscosity of the red color phosphor material is about 1.2 times compared to the green and blue phosphor materials. Therefore, even when the height of the phosphor layer is same, the film is thick.

The distribution of the phosphor particle size becomes uniform at the center portion, and the particles which are filled into the space between the round type particles are removed, so that it is possible to obtain a rough packing phosphor material formation.

During a light exposure by the phosphor material having the rough packing, a ultraviolet ray is strongly scattered by the particle surfaces of the phosphor material, so that the ultraviolet ray transmit into the Polyvinyl Alcohol (PVA) phosphor screen by a scattering in the space between the phosphor particles and the front surface of the panel 1 for thereby light-exposing the lower PVA, whereby it is possible to enhance an adhesive force of the panel 1 and the phosphor material dots. Therefore, a rough packing of the phosphor powder having a proper space between the phosphor particles and the front surface of the panel 1 is required for obtaining a fine pattern of the phosphor screen.

Figure 1:
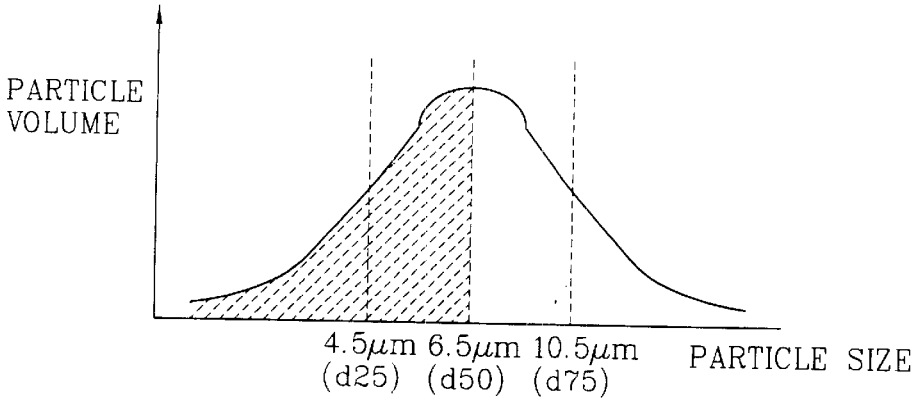
FIG. 1 CONVENTIONAL ART
FIG. 1 is a graph illustrating a particle distribution of a phosphor material for a conventional image display apparatus.
Figure 2:
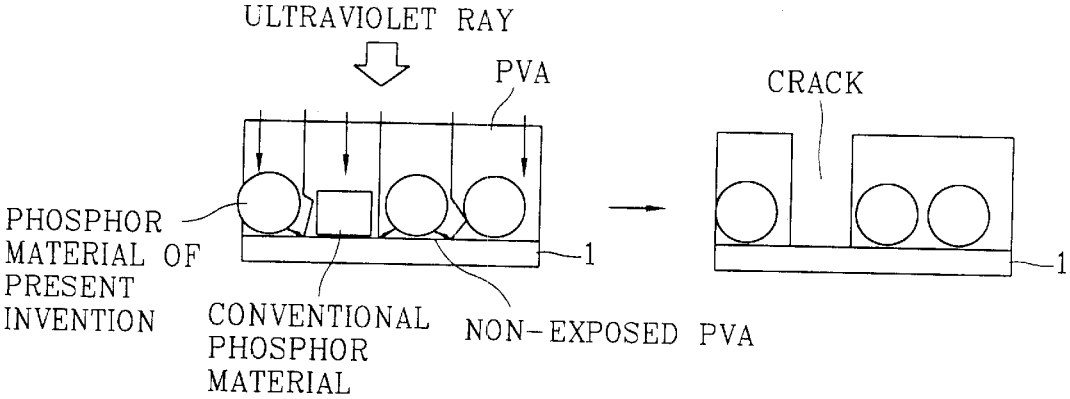
FIG. 2 CONVENTIONAL ART
FIG. 2 is a view illustrating a panel surface attachment characteristic between a phosphor material according to the present invention and a conventional phosphor material.

As shown in FIG. 2, in the case of the conventional hexagonal shape, the ultraviolet ray does not penetrate into the panel 1, so that the phosphor material is not attached to the panel 1. Therefore, the phosphor particles may drop from the panel 1. By contrast in the case of the round type phosphor according to the invention, the ultraviolet ray transmits to the panel 1, and the PVA and photosensitive material between the panel 1 and the phosphor particles are coupled, so that the phosphor material is attached to the panel 1.

Therefore, it is possible to remove cracks using the phosphor material powder having round particles and uniform phosphor size distribution according to the invention. This makes it possible for ultraviolet rays to penetrates into the bottom of the phosphor material through the spaces between the particles of the roughly packed phosphor material, so that even when the transitivity is relatively low, it is possible to obtain full ultraviolet ray exposure for thereby removing a crack problem and enhancing the luminance of the phosphor screen compared to the conventional art.

As the size of the particle of the phosphor is increased, the crystal degree which is a factor affecting the luminance is enhanced. If the size of the particle is increased, the electron beam radiated from the electron gun is scattered by the surfaces of the phosphor material, so that the electron beam can penetrate into a deep portion. Therefore, as the amount of the electron beams which penetrate into the interior of the phosphor material is increased, the luminance is enhanced more.

Since Fe group elements such as Fe, Co, Ni, etc. which affect the light emitting energy are provided on the surfaces of the phosphor material, the effective energy is decreased, and the phosphor layer having a large area has low light emitting efficiency compared to the interior of the phosphor layer. Since the surface area of the round type phosphor layer is relatively smaller, the luminance loss is small, and the sizes of the phosphor particles may be increased to 30 $\mu$m based on a plastic formation condition.

Figure 3:
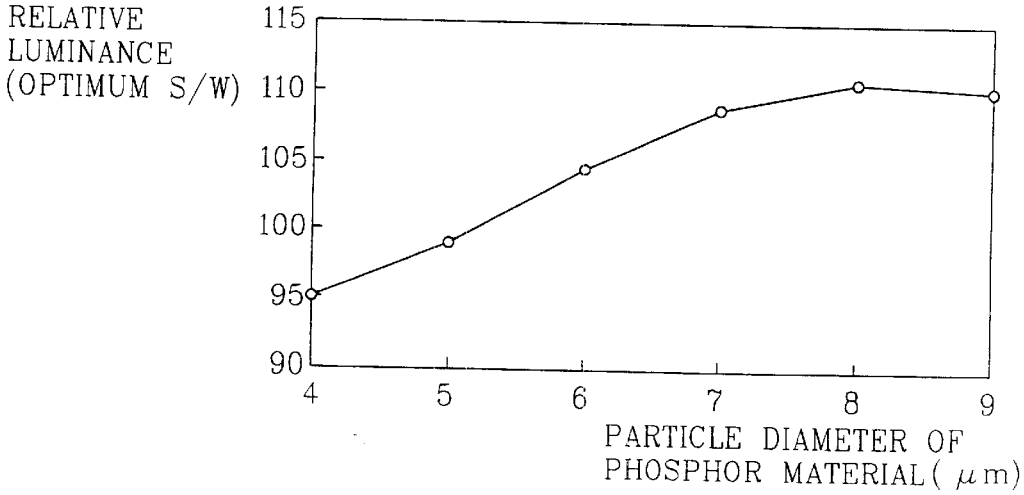
FIG. 3 is a graph illustrating a relationship between a particle diameter and luminance of a phosphor material.

FIG. 3 is a graph illustrating a luminance characteristic based on the average particle size of the phosphor material. As shown therein, the luminance is gradually increased in the case that the average particle size of the phosphor material increases. The increase continues until the average particle size is 7.5 m and stops when the average particle size exceeds 7.5 $\mu$m. Therefore, the particle size is increased up to 7.5 $\mu$m, and then the optimum film thickness is determined for thereby obtaining a luminance increase effect.

In order to obtain a high luminance, it is needed to maintain an optimum film thickness by increasing the size of the particle of the phosphor material.

The geometrical and optical characteristic of the phosphor surface is related to a phosphor material particle distribution, and the film thickness for determining the scattering amount is $S/W(g/cm^2)=(k/\rho)((\phi_2)^{-1}$ where K represents a constant, and $\rho$ represents a phosphor viscosity, and $\phi_2$ represents a size of particle. The total area of the phosphor particle is determined based on the number of the particle material rather than the whole thickness on the phosphor surface, and the number L of the particle material has been determined by experimentation to be about 1.4. When the voltage applied from the electron gun is 25 mV, the electron beam passes through the phosphor material having a thickness of about 10 $\mu$m. At this time, the amount of light emitted from the phosphor surface is determined based on an acceleration voltage and the density of the electron beam. The intensity of the light emitted based on the voltage is determined based on the density of the electron beam. Therefore, the suction of the light radiated by a phosphor particle and a minimization of the scattering should be considered when determining a proper thickness of the phosphor surface.

Figure 4A:
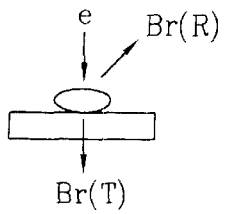
Figure 4B:
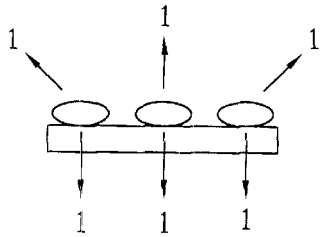
Figure 4C:
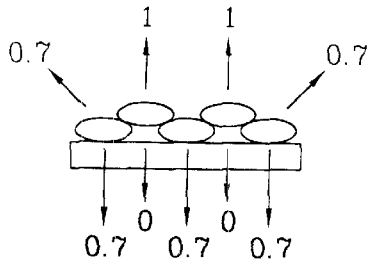

The screen weight SAN based on the optimum film thickness of the phosphor particle material is coated by the method as shown in FIG. 4, so the green and blue colors can be (0.38~0.42)×d50(mg/cm$^2$), and the red color can be (0.38~0.42)×d50×1.2(mg/cm$^2$). Since the actual viscosity of the red color phosphor material is about 1.2 times compared to the green and blue phosphor materials, even when the height is same, the film thickness is actually thick. Therefore, adapting 7.3 μm phosphor material, in the case of the green color, the S/W is 2.75~3.0, and in the case of the red color, the S/W is 3.2~3.6 mg/cm$^2$.

Figure 5:
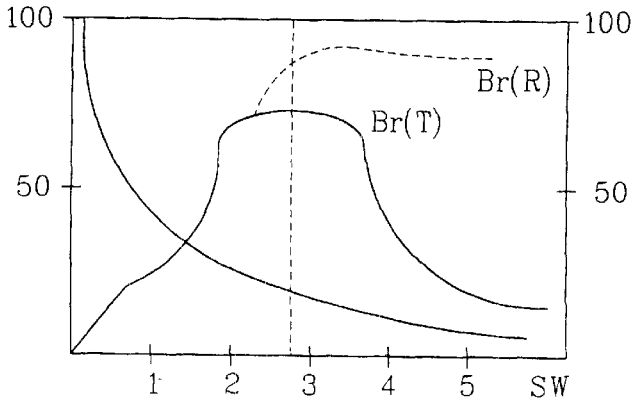
FIG. 5 is a graph illustrating a relationship between a film thickness and a transitivity of a phosphor material according to the present invention.

In FIGS. 4 and 5, "e" represents an electron beam, and Br(R) represents a reflection luminance, Br(T) represents a penetration, and S/T represents a beam penetration amount/beam incident amount.

In addition, in order to enhance a luminance characteristic by obtaining an optimum thickness of the phosphor material, when combining a phosphor slurry, the value of S (phosphor material/whole slurry as a viscosity factor) is increased, and the value of P (PVA/phosphor material as a density factor) is decreased. Therefore, the filling characteristic of the phosphor is enhanced, so that it is possible to obtain an optimum film thickness. At this time, the adding amount of a surface active agent among the slurry composition is decreased for enhancing an adhesive force of the phosphor material dot.

When the optimum film thickness is obtained, the light transitivity is decreased based on a constant light exposing amount. Therefore, the ultraviolet ray does not penetrate into the inner surface of the panel 1, so that the strengths of the panel 1 and the dot become weak, whereby the dots may be omitted. In order to overcome the above-described problems, the light exposing time is increased, and the intensity of the light exposure is increased, so that the widths of the dots are increased, and a color mixing problem occurs. Thereafter, the fine particle is removed from the round phosphor, and the particle size distribution becomes narrow at the center portion, so that the ultraviolet ray penetrates into the depth of the phosphor material by the scattering light for thereby increasing an effective light exposure and preventing dot omission and cracking. In addition, it is possible to prevent a crack by adjusting the adding amount of the surface active agent in the slurry composition.

An example of the present invention will be explained.

First, a ZnS compound of a Cu salt and Al salt is manufactured, and a fusing agent and ZnS are mixed and set in a furnace and are processed for about 60~120 minutes at a temperature of 880°~940° and are filtered using a 500 mesh, so that a rounded green phosphor material formed of a phosphor particle having an aspect ratio of 0.9 is manufactured.

In addition, the particle size distribution is made uniform at its center portion, so that the distribution of the particles having below 4 μm of S25 and above 11 μm of S75 is 4%, respectively, and Q.D is 0.15, and the particle size d50 is 7.3 μm larger than the conventional particle size.

Here, the phosphor material having a larger particle size has a bad cutting characteristic which represents a photosensitive state between a ultraviolet ray portion and a non-ultraviolet ray portion during a light exposure, and a bad filling characteristic of a phosphor material in a phosphor material dot. If there are too many particles, the light emitting luminance and light transitivity are decreased, and the luminance which represents a concentration is decreased.

Table 1 illustrates a composition of a phosphor material slurry.

TABLE 1

| Agent | Added amount |
|---|---|
| Pure water (including additional pure water) | 340 ml |
| 10% PVA solution | 100 ml |
| 5% SDC solution | 16 ml |
| Other additives (distribution agent, antifoam agent, incremental and decremental agents) | 15 ml |
| Phosphor material (rounded type, certain article size distribution) | 300 g |
| Total | 771 ml |

Here, in order to obtain a proper slurry coating characteristic (adhesive characteristic and cutting characteristic), the adding amount of the surface active agent which acts as a distribution agent and antifoaming agent is decreased. At this time, when the adding amount of the surface active agent is decreased by a certain level, the distribution characteristic of the slurry is degraded, and foams may occur thereby resulting in a certain problem.

In addition, when controlling the viscosity S, density P and sensitivity Q(SDC(sodium dichromate dihydrate)/PVA) which are basic characteristics of the slurry, in order to enhance the filling characteristic and thickness, an adding amount of viscosity correction liquid is decreased for thereby enhancing the viscosity S and the density P.

At this time, the viscosity is too increased, the adhesive force is weakened. If the film thickness exceeds a certain level, the electron beams do not penetrate into the whole portions of the phosphor material. Therefore, light emitted from the phosphor layer formed at a portion nearest the panel 1 is blocked thereby decreasing the luminance, so that the light scattering and penetration are bad during a light exposure thereby producing a crack formation problem.

In the conventional manufacturing condition, in the case of green color, S/W is below 2.510~2.550 mg/cm$^2$. In this case, it is possible to obtain 2.85 mg/cm$^2$ at the optimum film thickness by controlling the characteristic value of the slurry and manufacturing condition and increasing the film thickness.

The following table 2 illustrates a luminance characteristic of a cathode adapting a green phosphor material (rounded, and the average particle size is 7.3 m) according to the present invention. In this case, the remaining colors are the conventional color phosphor material.

TABLE 2

| Current applied | White (color coordinate, 0.280, 0.311 | Red color (solid color) | Green (solid color) | Blue (solid color) |
|---|---|---|---|---|
| 200 μm | 105.8% | 100.3% | 110.2% | 101.2% |
| 400 μm | 105.9% | 100.1% | 109.9% | 100.2% |
| 600 μm | 106.2% | 100.3% | 109.8% | 99.8% |
| 800 μm | 106.0% | 100.3% | 109.6% | 99.3% |

As shown in Table 2, the luminance is increased by 10% at the cathode which adapts the phosphor material according to the present invention.

The following table 3 illustrates a comparison between a film thickness and luminance based on a variation of viscosity and density of a phosphor material (when using an average particle size of 7.3 μm of a green phosphor material).

TABLE 3

| Viscosity | density | Film thickness | White luminance | Green |
|---|---|---|---|---|
| 1.370 | 19.5 | 3.148 | 92.4% | 92.6% |
| 1.350 | 21 | 2.997 | 94.5% | 94.4% |
| 1.330 | 21.5 | 2.883 | 98.6% | 98.8% |
| 1.310 | 22.6 | 2.770 | 101.8% | 102.1% |
| 1.290 | 23.4 | 2.664 | 102.0% | 102.1% |
| 1.270 | 23.6 | 2.524 | 100.0% | 100.0% |
| 1.250 | 23.8 | 2.464 | 93.8% | 94.1% |

In addition, Table 3 illustrates a S/W and luminance characteristic based on the viscosity of the phosphor material. In the case that the film thickness and viscosity of the phosphor is optimum, the phosphor material has the best luminance characteristic.

As described above, in the present invention, the phosphor material is formed in a round shape and has a bigger particle size compared to the conventional art. In addition, the particle distribution is uniform, so that it is possible to enhance a luminance characteristic of the phosphor surface.

Although the preferred embodiment of the present invention have been disclosed for illustrative purposes, those skilled in the art will appreciate that various modifications, additions and substitutions are possible, without departing from the scope and spirit of the invention as recited in the accompanying claims.

What is claimed is:

1. A phosphor surface formation method for an image display apparatus, the method comprising:

manufacturing a phosphor slurry including a rounded phosphor material having an aspect ratio (=shorter axis/longer axis) of 0.8~1.0, and an average particle size is in a range of 1~8 $\mu$m, coating the phosphor slurry on an upper surface of a panel, light-exposing the same using ultraviolet light, and removing a non-exposed portion of the same by using pressurized pure water;

wherein, in order to form a uniform particle distribution of the phosphor material, a Quartile Deviation (Q.D) parameter of said phosphor slurry is Q.D=(d75−d25)/(d75+d25) and the value of Q.D is below 0.2, wherein d25 is a particle size at a portion in which a volume of whole particles is 25%, and d75 is a particle size at a portion in which the volume of whole particles is 75%.

2. The method of claim 1, wherein in order to form a uniform particle distribution of phosphor material, the distribution of an elementary particle having a ½ size of an average particle size and an allele particle having a 3/2 particle size of an average particle size among particles of the phosphor material is below 5%.

3. The method of claim 1, wherein in order to obtain an optimum film thickness of the phosphor layer, in the case of green and blue colors, the film thickness in units of mg/cm$^2$ is (0.38~0.42)×d50, wherein d50 is a particle size at a portion in which a volume of whole particles is 50%, and in the case of a red color, the film thickness is (0.38~0.42)×d50×1.2.

4. The method of claim 1, wherein the slurry comprises water, polyvinyl alcohol, sodium dichromate dihydrate and the phosphor material.

5. The method of claim 4, wherein the slurry further comprises at least one selected from the group consisting of a distribution agent, an antifoam agent, an incremental agent and a decremental agent.

6. The method of claim 1, wherein the phosphor material comprises at least one metal selected from the group consisting of Fe, Co, Ni, Zn, Cu and Al.

7. The method of claim 1, wherein the phosphor material can be a red phosphor material, a green phosphor material or a blue phosphor material.

8. The method of claim 7, wherein a viscosity of the red phosphor material is about 1.2 times the viscosity of the green phosphor material and the blue phosphor material.

9. The method of claim 1, wherein the phosphor material is a 7.3 $\mu$m phosphor material, and in the case of green color an S/W is 2.75–3.0 mg/cm$^2$, wherein S/W is the screen weight of the phosphor material per unit area.

10. The method of claim 1, wherein the phosphor material is a 7.3 $\mu$m phosphor material, and in the case of red color an S/W is 3.2–3.6 mg/cm$^2$, wherein S/W is the screen weight of the phosphor material per unit area.

11. The method of claim 1, wherein the phosphor material is a 7.3 $\mu$m phosphor material, and in the case of green color has an S/W greater than 2.550 mg/cm$^2$, wherein S/W is the screen weight of the phosphor material per unit area.

* * * * *